US005524348A

United States Patent [19]

Tipp

[11] Patent Number: 5,524,348

[45] Date of Patent: Jun. 11, 1996

[54] SYSTEM FOR SLITTING AND OPENING PACKAGES

[76] Inventor: Raymond P. Tipp, P.O. Box 3778, Missoula, Mont. 59806

[21] Appl. No.: 285,696

[22] Filed: Aug. 4, 1994

[51] Int. Cl.[6] ..... B67B 7/46

[52] U.S. Cl. ..... 30/294; 30/2; 30/289; D8/98

[58] Field of Search ..... 30/2, 280, 294, 30/314, 317, DIG. 3, 289, 296.1, 298, 298.4, 286; 83/56, 856, 912; D7/695; D8/98, 102

[56] References Cited

U.S. PATENT DOCUMENTS

| | | | |
|---|---|---|---|
| 2,599,439 | 6/1952 | Drake | 30/294 X |
| 3,028,670 | 4/1962 | Tilly | 30/294 |
| 3,178,812 | 4/1965 | Lurie | 30/2 |
| 3,448,519 | 6/1969 | Tobias | 30/314 X |
| 5,007,171 | 4/1991 | Horning, Jr. | 30/DIG. 3 X |
| 5,103,562 | 4/1992 | Braatz | 30/294 |
| 5,285,577 | 2/1994 | Carney et al. | 30/DIG. 3 X |

*Primary Examiner*—Rinaldi I. Rada

*Assistant Examiner*—Clark F. Dexter

*Attorney, Agent, or Firm*—Harry M. Cross, Jr.

[57] ABSTRACT

A hand-held slitting device for slitting open a package having a sealed edge, the hand-held slitting device having an insertion slot and a pointed blade protruding into an insertion slot. The package may be inserted into the insertion slot so as to bring a surface of the package against the pointed blade, and slit open by manipulating the package and the slitting device so as to cause the pointed blade to pierce the sealed edge and to cut through the sealed edge as the package is withdrawn from the insertion slot. The slitting device comprises a main body section of a size that is convenient to be grasped by a user's thumb and fingers, an arm section extended from the body section and provided with an inwardly extending end protrusion, and a slitting blade provided with an exposed sharpened cutting edge. The slitting blade is mounted by the body section in a way such that its sharpened cutting edge is inclined forwardly to end at a tip that is disposed adjacent to the end protrusion. There is a space between the blade tip and the inner side of the arm section that is sufficient to enable a sealed edge of a package to be inserted in the space to bring the blade up against the blade tip.

9 Claims, 2 Drawing Sheets

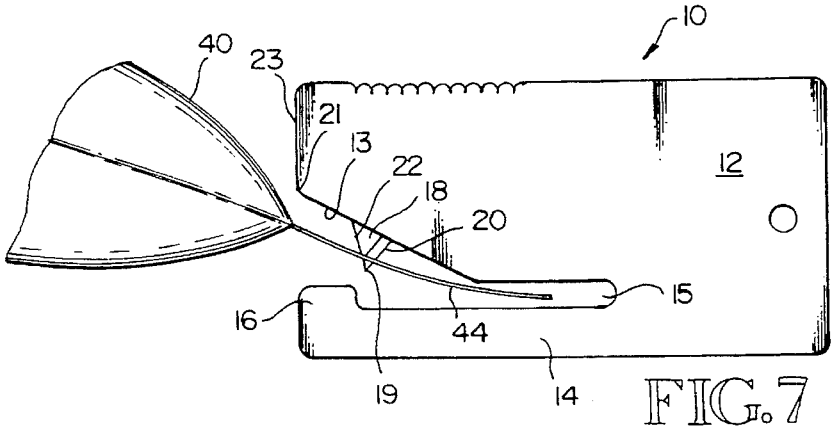
FIG. 7
FIG. 2
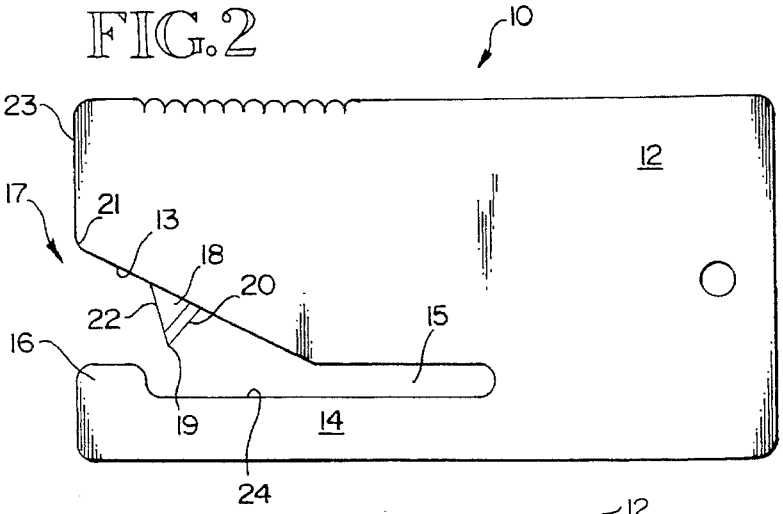
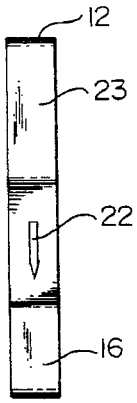
FIG. 3
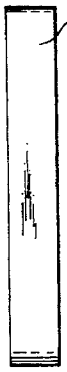
FIG. 4
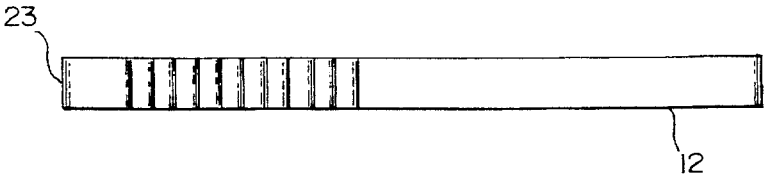
FIG. 5
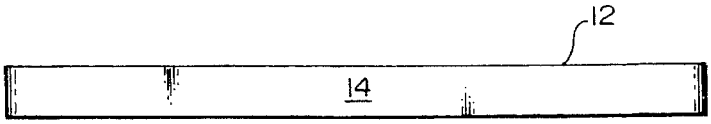
FIG. 6

SYSTEM FOR SLITTING AND OPENING PACKAGES

FIELD OF THE INVENTION

This invention relates to devices for opening bags and packages utilizing bag/package—piercing slitter.

BACKGROUND OF THE INVENTION

Bags and packages of the type containing food stuffs are often sealed at the top, leaving a sealed relatively flat portion extending outward from the sealed storage compartment. Potato chip bags, cereal bags, frozen foods, and other food stuffs, as examples, are usually stored in plastic bags that are heat-sealed after being filled, leaving a sealed edge across the width of the top of the bag. Such bags are inconvenient to open easily. Often, the consumer will cut the bag open by cutting through the sealed lip with a scissors or a knife, or attempt to grasp the sides of the bag and pull the sealed edges apart to expose the contents.

Other types of packages, such as pouch-type envelopes, also have openings that can be sealed by means of an adhesive or staples, leaving a sealed edge across the width of the packaging. These kinds of packages are also inconvenient to open easily. Similarly, flat envelopes of the kind used for mailing papers and the like, have sealed edges and are not conveniently opened easily.

The common feature of these types of packaging, when sealed, is the provision of a relatively flat, sealed edge that is not easily opened in a quick and efficient manner.

SUMMARY OF THE INVENTION

It is a primary object of this invention to provide a simple device for slitting open the sealed edges of such types of packaging, either by slitting through transversely across the sealed edge or by slitting through the sides of the packaging storage compartment adjacent and parallel to the sealed edge.

A package having a sealed edge may be slit open by a hand-held slitting device having an insertion slot and a pointed blade protruding into said insertion slot. The package may be inserted into the insertion slot so as to bring a surface of the package against the pointed blade, and slit open by manipulating the package and the slitting device so as to cause the pointed blade to pierce the sealed edge and to cut through the sealed edge as the package is withdrawn from the insertion slot. The slitting device comprises a main body section of a size that is convenient to be grasped by a user's thumb and fingers, an arm section extended from the body section and provided with an inwardly extending end protrusion, and a slitting blade provided with an exposed sharpened cutting edge. The slitting blade is mounted by the body section in a way such that its sharpened cutting edge is inclined forwardly to end at a tip that is disposed adjacent to the end protrusion. There is a space between the blade tip and the inner side of the arm section that is sufficient to enable a sealed edge of a package to be inserted in the space to bring the blade up against the blade tip.

The arm section extends forwardly a sufficient distance that its end protrusion is located forwardly of the blade tip; and there is a space between the blade tip and the inner side of the arm section that is sufficient to enable the edge of a package to be inserted in that space to bring the blade up against an exposed face of the package. Thus, when a package is positioned for slitting by a portion thereof being inserted into that space, the arm section will extend over the package edge so that the blade tip will bear against the outer surface of the package; and, when the inserted package portion is withdrawn from the space, the blade tip will pierce the inserted package portion and the blade cutting edge will cut through inserted package portion.

BRIEF DESCRIPTION OF THE DRAWINGS

FIG. 2 is a side view in elevation of the package opening device of this invention;

FIG. 3 is a front end view of the FIG. 2 device;

FIG. 4 is a rear end view of the FIG. 2 device;

FIG. 5 is a top edge view of the FIG. 2 device;

FIG. 6 is a bottom edge view of the FIG. 2 device; and

FIG. 7 is a side elevation view, similar to FIG. 2, with the sealed edge of a bag inserted preparatory to being slit open.

DETAILED DESCRIPTION OF THE INVENTION

Figure 1:
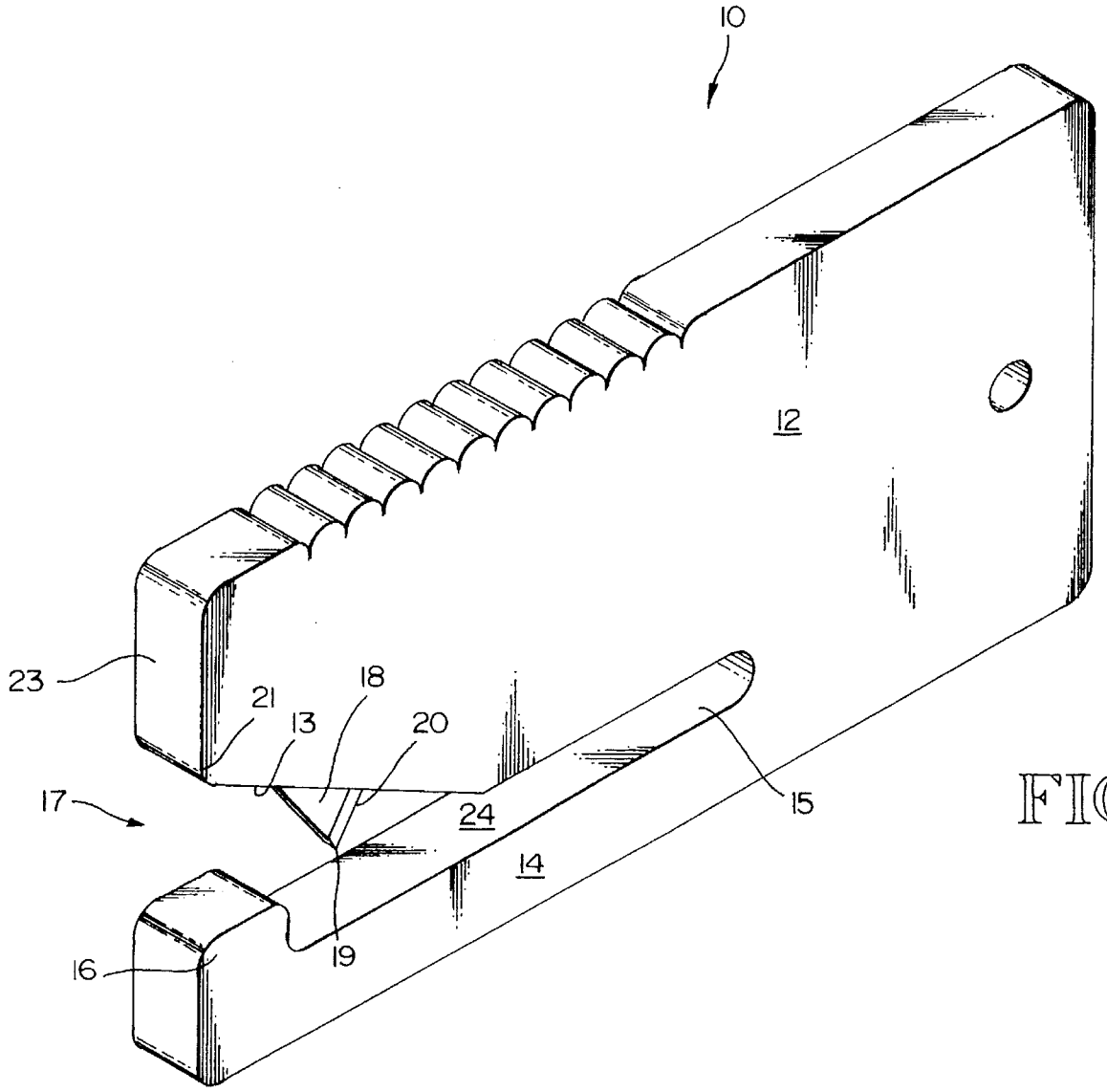
FIG. 1 is a view in perspective of the bag package opening device of this invention.

The principal utility of this invention will be for slitting bags and pouches that are filled and sealed so as to provide a relatively bulky storage compartment with a relatively flat sealed edge extending the width of the compartment. In such bags and pouches, the storage compartment is filled through an open end and it is that end that is sealed closed to provide the relatively flat sealed edge. That storage compartment is designed to be opened by unsealing or breaking through the sealed edge.

Most often, this invention will be used to slit open bags and pouches containing food stuffs. Hence, by way of convenience and not by way of limitation, the device of this invention will sometimes hereinafter be referred to as a "bag" slitting device, or opener. It will be recognized that the device may be used to slit open any type of package that presents a relatively flat edge that can be inserted into the device for piercing and slitting. This would include mailing envelopes of the type having at least one relatively flat edge.

The bag slitting device 10 comprises a main body section 12 of a size that is convenient to be grasped by a user's thumb and fingers. The device 10 also includes an arm section 14 that is provided with a inwardly extending end protrusion 16, and a slitting blade 18. The slitting blade 18 is mounted within body section 12 in a way such that its sharpened cutting edge 20 is inclined forwardly toward end protrusion 16 to end at a tip 19. Tip 19 is located near the rear-most edge of end protrusion 16. The arm section 14 extends forwardly from its region of connection with body section 12. Arm section 14 is separated along its length from body section 12 by an elongated slot 15. The opening 17 into slot 15 is defined by the end protrusion 16 and the opposing edge 21 of the front end 23 of body section 12. The relationship between blade tip 19 and the outermost point of end protrusion 16 is such that blade tip 19 extends into the slot 15. There is a space between the blade tip 19 and the inner side 24 of arm section 14 that is sufficient to enable the sealed edge 44 of a package 40 to be inserted into the slot 15 past the blade tip 19 to the end of the slot.

The tip 19 and cutting edge 20 of blade 18 are oriented such that the portion of the packaging inserted in slot 15 may be drawn into tip 19 so that tip 19 pierces the packaging. Then, as the packaging is drawn back out of the slot 15, the piercing tip 19 will present the cutting edge 20 such that the packaging is slit during the withdrawal.

When the package 40 is inserted into the slot 15, the end protrusion 16 will bear against the surface of the packaging and cause the packaging material to curve or bend as it rides along the inner side 24 of the arm section 14. When the packaging is then withdrawn from the slot 15, by relative separating movement between the package 40 and the bag opener 10, the packaging material will tend to straighten out. This tendency to straighten out will effect piercing contact between the packaging material and the blade tip 19. In order to insure that the packaging material is pierced by blade tip 19, the bag opener may be rotated into the plane of the package so as to drive the blade tip 19 into the surface of the packaging material as the package is withdrawn from the slot 15.

The innermost region of slot 15 is oriented generally parallel to arm 14. The outermost region of slot 15 may be opened wider by tapering the edge 13 of body section 12 that extends opposite the locus of end protrusion 16. In this preferred embodiment, the blade 18 would be mounted so as to protrude from this edge 13 in the orientation previously described. The blade 18 is preferably recessed from the front end 23 of body section 12, and the opening 17 into slot 15 is wider than the innermost portion of slot 15. Also, in this embodiment, the forward edge 22 of blade 18 may be inclined rearwardly so as to provide an incline that would direct the edge of packaging material toward the inner side 24 of arm 14 and behind the end protrusion 16 as the packaging is inserted into the slot 15.

A preferred embodiment of the slitting device 10 is about 3/16 inches thick and has a body 12 that is about 2 11/16 inches long and about 1 5/16 inches high; an arm 14 that is about 1 9/16 inches long and about 1/4 inches wide; a slot 15 about 1/8 inches wide; an end protrusion 16 that extends inwardly about 1/8 inches from the inner side 24 of arm 14, a blade 18 having a cutting edge 20 that extends forwardly at about a 45° angle with respect to the inner side 24 of arm 14, with its blade tip 19 spaced about 1/4 inches outward so that the gap between the end protrusion 16 and the blade tip 19 is between about 1/16 and 1/8 inches, and so that the gap between the inner side 24 of arm 14 and the blade tip 19 is also between about 1/16 and 1/8 inches. The device 10 is preferably fabricated from a plastic material, blade 18 is preferably fabricated from a thin piece of steel, and blade 18 is preferably molded into the body 12 and protrudes therefrom as shown in the Figures. One corner of the body 12 may be provided with a transverse hole 13 so that a bead chain or cord can be attached to the body; thereby affording a means for hanging the device on a hook or the like in an accessible location. A magnet strip may be secured to one side of the body 12 so that the device 10 could be fastened to a refrigerator door or other metal surface for convenient access.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A package slitting device having front and rear ends which comprises a main body section of a size that is convenient to be grasped by a user's thumb and fingers; an arm section projecting from said body section and oriented so as to provide an elongated slot open between an inner side of said body section and an inner side of said arm section, said arm section terminating at the front end of said device, said slot having an open front end and a closed rear end, said slot front end being located at the front end of said device and said slot closed rear end being located between the front and rear ends of said device; and a slitting blade provided with an exposed sharpened cutting edge, said slitting blade being mounted by said body section with its sharpened cutting edge facing rearwardly toward the closed rear end of said slot and extending into said slot from the inner side of said main body section toward the inner side of said arm section to end at a blade tip located in said slot between the front end of said device and the rear end of said slot; the inner side of said body section having first and second portions, the first portion extending at an incline from the front end of said device toward the inner side of said arm section, the second portion extending from the first portion to the rear end of said slot parallel to the inner side of said arm section; said slitting blade extending from the first portion of the body section inner side and said blade tip and the inner side of said arm section being spaced apart sufficiently to enable a portion of a package to be inserted into the slot from the front end of said device and between said blade tip and said arm section to bring said blade tip against an outer surface of the package, whereby, when a package positioned for slitting by a portion thereof being inserted into said slot said arm section will extend over the package portion so that said blade tip will bear against the outer surface of the package, and whereby, when the inserted package portion is withdrawn from said space, said blade tip will pierce the inserted package portion and said blade cutting will cut through the inserted package portion.

2. The slitting device of claim 1 wherein a front edge of said blade faces forwardly toward the front end of said device and is inclined from said main body section rearwardly toward said arm section for guiding a package portion into said slot and between said blade tip and the inner side of said arm section.

3. The slitting device of claim 1 wherein the cutting edge of said blade is inclined from said main body section forwardly toward said arm section for slicing open the inserted package portion when that portion is withdrawn.

4. The slitting device of claim 1 wherein said body section and said arm section are fabricated from a plastic material such that these sections are thin and generally rectangular, and wherein said blade is fabricated from a thin piece of steel and molded into said body to protrude therefrom.

5. The slitting device according to claim 4 wherein said arm section is provided with an end protrusion located at the front end of said device, said end protrusion protruding into said slot to provide a restricted opening into said slot at the front end of said device; and wherein said blade tip is located between said end protrusion and the closed end of said slot whereby, when said slitting device is pivoted, said blade tip will be rotated into the inserted package portion so as to pierce the inserted package portion.

6. The slitting device of claim 5 wherein said end protrusion is located opposite the first portion of the body section and said blade tip is located between said end protrusion and the second portion of the body section.

7. The slitting device of claim 5 wherein a front edge of said blade faces forwardly toward the front end of said device and is inclined from said main body section rearwardly toward said arm section for guiding a package portion into said slot and between said blade tip and the inner side of said arm section.

8. The slitting device of claim 5 wherein the cutting edge of said blade is inclined from said main body section forwardly to said arm section for slicing open the inserted package portion when that portion is withdrawn.

9. The slitting device of claim 5 wherein a front edge of said blade is inclined from said main body section rearwardly toward said arm section for guiding a package portion into said space behind said end protrusion; and wherein the cutting edge of said blade is inclined from said main body section forwardly to said arm section for slicing open the inserted package portion when that portion is withdrawn.

* * * * *